US006277439B1

(12) United States Patent
Painter

(10) Patent No.: US 6,277,439 B1
(45) Date of Patent: Aug. 21, 2001

(54) IMPREGNATION OF LEATHER WITH MICRO-ENCAPSULATED MATERIAL

(75) Inventor: Robert Painter, Yeovil (GB)

(73) Assignee: Pittards Public Limited Company, Yeovil (GB)

( * ) Notice: Subject to any disclaimer, the term of this patent is extended or adjusted under 35 U.S.C. 154(b) by 0 days.

(21) Appl. No.: 09/299,494

(22) Filed: Apr. 26, 1999

(51) Int. Cl.[7] ..... B05D 3/12
(52) U.S. Cl. ..... 427/180; 427/359
(58) Field of Search ..... 427/180, 359

(56) References Cited

U.S. PATENT DOCUMENTS

| | | | |
|---|---|---|---|
| 41,011 | 12/1863 | Lightfoot . | |
| 2,287,744 | 6/1942 | Monahan . | |
| 2,763,577 | 9/1956 | Lawler . | |
| 2,884,403 | 4/1959 | Zorn et al. . | |
| 2,941,859 | 6/1960 | Fein . | |
| 3,053,697 | 9/1962 | Zorn et al. . | |
| 4,510,188 | 4/1985 | Ruggeri . | |
| 4,514,461 | 4/1985 | Woo . | |
| 4,634,118 | 1/1987 | Jensen . | |
| 5,368,609 | 11/1994 | Inoue . | |
| 5,418,051 * | 5/1995 | Caldwell | 427/358 |
| 5,759,706 | 6/1998 | Widdemer . | |

FOREIGN PATENT DOCUMENTS

| | | |
|---|---|---|
| 39 21 145 | 1/1991 | (DE) . |
| 3921145 | 1/1998 | (DE) . |
| 9320 | of 1911 | (GB) . |
| 580121 | 4/1943 | (GB) . |
| 580120 | 9/1946 | (GB) . |
| 1030700 | 5/1998 | (JP) . |
| 95/34609 | 12/1995 | (WO) . |

OTHER PUBLICATIONS

The Treatment of Leather with Colloidal Graphite, The Industrial Chemist, 411, Oct., 1932.

P. I. Smith, Principles and Processes Of Light Leather Manufacture, Hide and Leather Publishing Co. 227–231, 1942.

The Leather World, Gas Meter Diaphragms, 274, May 14, 1953.

Kedlaya et al., Metallic Finishing of Leathers with Graphite, 1973, pp. 216–217, Leather Science vol. 20.

* cited by examiner

*Primary Examiner*—Erma Cameron
(74) *Attorney, Agent, or Firm*—Kenyon & Kenyon

(57) ABSTRACT

A material is impregnated into leather by incorporating the material into micro-capsules and then applying the micro-capsules to the leather material by means of a suitable process. A roller coating process is described in which the material is applied to a roller under which the leather material passes whilst compressed. Alternatively, the micro-capsules may be applied to the leather by drumming-in in a wet process.

20 Claims, 1 Drawing Sheet

IMPREGNATION OF LEATHER WITH MICRO-ENCAPSULATED MATERIAL

FIELD OF THE INVENTION

This invention relates to a method of impregnating leather with a material which is incorporated into the leather in a micro-encapsulated material.

BACKGROUND OF THE INVENTION

In the leather processing industry, there is a large number of additives, agents, etc., which need to be impregnated into the body of the leather so that they can perform their required function effectively. In the past, such materials have been impregnated into the leather using a number of different processes according to the nature of the additive, agent, etc. The present invention is concerned with providing a general purpose method which is capable of impregnating a wide range of different materials into the leather, but using a generally similar process. Accordingly the present invention contemplates first encapsulating the material or agent into a micro-encapsulated form. Once in this form, the impregnation process may be determined substantially on the basis of the size and composition of the micro-capsule shells rather than exclusively on the basis of the material which is required to be added.

U.S. Pat. No. 4,510,188 describes a method for making a textile or leather material with a chromatic effect in which a layer of a micro-encapsulated liquid cholesteric crystal material is applied to the surface of the textile material or leather. The micro-encapsulated material is applied as a dispersion of capsules in a synthetic resin. In this process, the material is applied as a surfacial layer rather than being impregnated into the fibrous structure of the leather. The present invention differs from the processes disclosed in U.S. Pat. No. 4,510,188 because they require an encapsulated material to be at least partially impregnated into the leather rather than remaining as a surfacial layer U.S. Pat. No. 5,368,609 discloses a process for softening leather in which thermoexpansible microcapsules (TEMCs) are impregnated into the leather and then caused to expand. The TEMCs contain a volatile liquid which is designed to evaporate and cause the capsule to expand by preferably ten to sixty times their original volume. This technique is concerned with the mechanical function of the microcapsules rather than using the capsules as a vehicle for impregnating material into the leather. The microcapsules are impregnated into the leather in a wet process.

German Published Application DE-A-3921145 discloses an arrangement for rendering leather surfaces matt. In this process a microcapsules material is applied to the surface of the leather by means of a spray gun, to provide a surfacial coating.

WO95/34609 discloses an arrangement in which a binder containing encapsulated phase change materials is coated to a leather substrate. This Specification refers to a surfacial coating rather than a partial or complete impregnation of the leather material.

SUMMARY OF THE INVENTION

This invention is therefore concerned with providing a method whereby a wide range of different agents, additives, etc. may be incorporated into the leather to impart to it properties otherwise difficult or impossible to attain consistently and permanently in the context of normal use. Examples of such additives include biocides, scents, colourants, softening agents, fillers, levelling agents, fault observing agents, abrasion enhancers, magnetic substances, humectants, water-proofing agents and fire-retarding agents.

Furthermore the invention is concerned with selectively focusing the application of the micro-encapsulated material to the required region of the leather, whether this be impregnated throughout the thickness of the leather, confined to a restricted layer of the thickness at or below surface level, or additionally including a surfacial layer.

It will be appreciated that, in the leather processing industry, no two skins are identical and so it is therefore advantageous to be able to provide a general purpose process which provides generally consistent results within individual skins, from skin to skin within a process batch, and between process batches.

Accordingly, in one aspect, this invention provides a method of impregnating leather with a material, which comprises the steps of:

impregnating leather with a material, which comprises the steps of:

providing a micro-encapsulated supply of said material;

applying said micro-encapsulated material to the flesh side of said leather using a roller which applies pressure to said leather, thereby to cause said micro-encapsulated material to be impregnated in said leather.

Preferably said micro-encapsulated material is applied to the surface of said roller at a controlled rate, typically of between 60 $g/m^2$ and 180 $g/m^2$.

The micro-encapsulated material preferably has a capsule size in the range of from 5 to 40 microns.

The leather is preferably conveyed past said roller by a conveyor belt means. The conveyor belt means and said roller may have substantially the same linear speed and direction. However, in certain applications it may be desirable for the speeds to be different to provide a differential slip effect between the roller and the leather. In other instances it may be useful to have the roller and the conveyor belt means running in different directions to provide a strong scrubbing action.

Preferably the conveyor belt means and said roller have a linear speed of between 2 and 10 m/min.

The micro-encapsulated material is preferably in the form of a liquid slurry comprising an aqueous base and one or more agents selected from thickening agents, wetting agents, dispersants, and flow aids.

Preferably, the roller provides a compression action on the leather such that the roller gap is between 60% and 90% of the thickness of the uncompressed leather. This means that the leather is compressed as it passes under the roller and re-expands immediately thereafter and this action is thought to enhance absorption of the micro-encapsulated material into the fibrous matrix of the leather.

Although in many instances a single pass will be sufficient, the leather may be passed two or more times past the roller to achieve the required amount of impregnation.

One of the advantages of the method of this invention is that it allows a substantially uniform impregnation of the micro-encapsulated material throughout the fibrous matrix. This means that the packing density of the micro-encapsulated material within the leather for a given application rate is minimized, thereby reducing the effect that the impregnation has on the "feel" of the leather. In the case of non-uniform impregnation near the surface of the leather, the packing density of the micro-encapsulated material is relatively high which means that the leather can feel stiff.

In another aspect, this invention provides a method of impregnating leather which comprises the steps of:

providing a micro-encapsulated supply of said material, introducing said micro-encapsulated material into a drum containing said leather and a liquid float, and drumming said micro-encapsulated material into said leather in a wet process.

Preferably said wet process is carried out at a temperature of between 40° C. and 50° C. The encapsulated material is preferably introduced into the wet process at rate of approximately 50% of the dry weight of the leather.

Although longer or shorter periods may be required, it is preferred for the drumming step to be performed for at least one hour.

The micro-encapsulated material may be drummed into the leather during a retanning process, in which the pH of the liquid float is preferably maintained at a value of from 5.5 to 6.0.

Alternatively or additionally, the micro-encapsulated material may be drummed into the leather during a dyeing process in which case the pH is preferably maintained at a value in the range of 6.0 to 7.5.

Additionally or alternatively, the material may be drummed into said leather during a fatliquoring process, in which case the pH of the liquid float is preferably maintained at a value in the range of from 5.5 to 6.5.

Whilst the invention has been described above, it extends to any inventive combination of features set out above or in the following description.

DETAILED DESCRIPTION OF THE INVENTION

Figure 1:
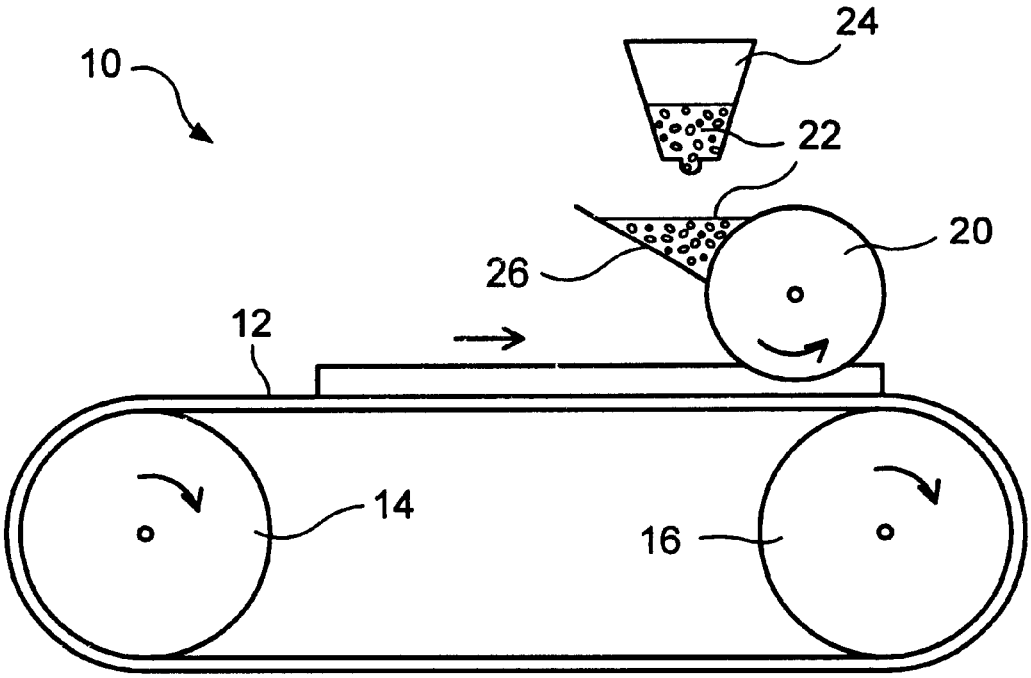
FIG. 1: Various examples of the invention will now be described, reference being made to the accompanying drawing which is a schematic view of a roller coating process utilised in one of the examples.

Two methods of application of micro-encapsulated materials are described herein and the specific method used will depend on the properties to be imparted by the material, namely a wet process and a roller coater process. For instance, micro-encapsulated scents may need to be deposited randomly throughout the fibre structure of the leather, in which case they may be applied in a wet process during the retanning, and/or dyeing, and/or fatliquoring operations. Other micro-encapsulated materials, such as colouring agents may need to be impregnated at a controlled application amount in to the leather matrix; in this case a roller coating process may be used.

Wet Process

The micro-encapsulated materials are available either in the form of a dry powder or as an aqueous dispersion. In the wet process, the micro-encapsulated materials are introduced to the leather when it is undergoing other chemical treatments in the process vessel or "drum". The leather is placed within the drum and the chemical treatments are applied either directly to the drum or in a "float" of water. The process parameters which can be manipulated to achieve the desired results include the weight of the chemicals offered relative to the leather weight, the process time, the rotating speed of the drum, the pH, volume and/or temperature of the float, and the chemical concentration within the float.

The micro-encapsulated materials may be offered to the leather during one or more of the following wet processes, which are designed to modify various characteristics of the leather:

Retanning—this process is carried out typically to alter the feel, thickness, grain "break" and/or looseness of the leather, and to allow penetration and levelness of dyeing;

Dyeing—this process is carried out to give the desired colour of the leather, and this colour may be penetrated throughout the cross-section of the leather, partially through the cross-section or only on the leather surface.

Fatliquoring—this process is carried out to soften the leather, lubricating the leather fibres by coating them with oil.

The micro-encapsulated materials may be added during one or more of the retanning, dyeing or fat liquoring stages and the effect determined by routine experimentation and selection of the use of the above parameters of temperature, pH, etc.

In another embodiment, the micro-encapsulated material may be added to the leather in the drum before the leather has been fully wetted out or after wetting out but before any retanning, dyeing or fatliquoring stage.

EXAMPLE 1

The temperature of the float is adjusted to between 40° C. and 50° C. and the pH to a value suitable for the chosen leather-making stage, for example pH 5.5 to 6.0 for retanning, 6.0 to 7.5 for dyeing, and 5.5 to 6.5 for fatliquouring.

The dry weight of the leather to be treated is determined and a suitable amount of micro-capsules, based on a percentage of the weight of leather is added. The choice of the micro-capsules and the property that they impart to the leather will determine the amount that is added, but in a typical embodiment the dry capsules are added at a rate of 50% of the weight of the dry leather.

The required weight of capsules are dispersed in the same weight of water at 50° C. with a wetting agent such as Tergolix AL (Clariant UK Ltd., Calverley Lane, Horsforth, Leeds, LS18 4RP, England) at an amount of half a percent based on the weight of capsules. Tergolix AL wetting agent is particularly useful for this because its amphoteric nature allows it to be used in a wide range of pH conditions and with other chemicals.

The dispersion so formed is added to the float whilst the drum is rotating and the capsules are caused to penetrate into the leather structure by the drumming action.

The process condition are followed as for the normal selected leather processing stage whilst the micro-capsules are being drummed in, but allowing a minimum of sixty minutes running time after the micro-capsules have been added, before draining or washing the leather.

If required, the micro-capsules may be added in more than one leather processing stage.

Roller Coater Process

In this process the micro-encapsulated material is applied to the leather by rolling it into the flesh side thereof. A roller coater arrangement 10 is shown in the drawing. A conveyor belt 12 runs over rollers 14 and 16, is one of which is driven. Disposed above the upper run of the conveyor, by an adjustable distance, is a roller 20 which, in this embodiment, is driven to have the same linear speed and direction as the conveyor. The roller 20 is coated with slurry material 22 from a reservoir 24 and the amount of coating on the roller is controlled by a doctor blade 26. The roller surface is embossed or otherwise patterned to provide the required coating amount.

In use the roller spacing is set up so that the minimum gap is approximately 75% of the uncompressed thickness of the leather to be treated. The roller 20 and the conveyor are set in motion so that the roller has a controlled coating thereon and a piece of leather is fed under the roller by placing it on the conveyor upstream thereof. As the leather is passed under the roller it is compressed to approximately 75% of its thickness and then relaxed, during which process the material on the roller is transferred to the leather and absorbed into the structure thereof. If required the leather piece may be passed under the roller one or more further times.

In this process, the micro-encapsulated material is absorbed into the dry structure of the leather, using the natural fibre matrix of the leather as a means of holding the measured amount of micro-encapsulated material within the leather structure, with or without the use of additional binders.

In this process, the capsules are applied to the leather structure by a combination of mass effect and the pressure applied by the roller system to the leather surface. The latter has a squeezing effect, which forces the capsules into the structure of the leather. This reinforces the natural absorbing character of the leather to draw liquids into its matrix. The amount supplied can be adjusted in a number of different ways, either singly or in combination. The proportion of capsules in the treatment can be increased or decreased, thereby adjusting the amount of material applied. The treatment may be applied in one or multiple coats. Where desired, a further deposition of capsules may be applied to the surface of the leather, as an extension of the treatment already within the structure.

The application of the pressure of the roller is an important feature in helping to force the capsules into the fibre matrix. Two of the factors that effect this penetration are the surface tension of the treatment, and the pressure applied by the roller. In general, the lower the surface tension and the higher the roller pressure, the deeper the capsules will penetrate. These variables, coupled with the capsule concentration and the number of passes, allow the operator to determine the rate and depth of treatment applied. This embodiment therefore allows the operator to control the extent of penetration, ranging from a coating which barely penetrates the flesh side of the leather, to one in which the leather is substantially uniformly impregnated.

The surface tension may be adjusted in a number of ways which will be known to those skilled in the art. For instance a solvent or a surface active agent such as a detergent may be used, but the invention is not so limited. The pressure applied by the roller likewise may be controlled or adjusted by any of the ways known to those skilled in the art.

The micro-encapsulated material may be either of liquid or powder origin and may be mixed with combinations or resins, waxes, fillers and viscosity modifiers to give a blend of suitable viscosity and Theological properties to be applied by the roller coating machine.

EXAMPLE 2

An aqueous mixture was made up with the following parts by weight:

| | |
|---|---|
| Water | 700 |
| Thickener: RM825 (Stahl GB Ltd, Bakewell Road, Loughborough LE11 5RD, England) | 15 |
| Wetting Agent: Teroglix AL (Clariant) | 10 |
| Dispersant: Encryl J (Earnshaw Chemicals Ltd, Darlington Road, North Allerton, North Yorkshire, DL6 2PQ, England) | 25 |

-continued

| | |
|---|---|
| Micro-capsules | 240 |
| Flow Aid: LA 168 (Stahl) | 10 |

The micro-capsules may be of any suitable form to act as a vector for the material to be impregnated into the leather. Thus the micro-capsule shells may be formed of urea formaldehyde resins, paraffin waxes and yeast cells, polyvinylchloride, polyvinylidene chloride, polyolefin, polyester, polyurethane, polyacrylate, polyvinylacetate, polystyrene, or co-polymers thereof. In this example the typical capsule size is between 5 and 20 microns.

The above composition was mixed to form a slurry which was used to fill the reservoir 24 of a roller coater apparatus of the form shown in the drawing. The viscosity of the slurry was 5.5 secs (measured by BS3900A6, Ford No. 6 cup). The roller 20 and doctor blade 26 are set up to provide an application level of between 60 g/m$^2$ and 180 g/m$^2$ of the slurry as a whole.

The minimum roller gap was set to be 0.2 mm and the linear speeds of the roller and the conveyor set to be 5 m/min.

Dry leather of thickness 0.45 mm was then fed under the roller to be impregnated with the micro-encapsulated material.

This caused the micro-capsules to be impregnated throughout a major part of the thickness of the leather.

What is claimed is:

1. A method of impregnating leather with a material, which comprises the steps of:

providing a micro-encapsulated supply of said material;

applying said micro-encapsulated material to the flesh side of said leather using a roller which applies pressure to said leather, thereby to cause said micro-encapsulated material to be impregnated in said leather.

2. A method according to claim 1, wherein the micro-encapsulated material is applied to the surface of said leather at a controlled rate.

3. A method according to claim 1, wherein said micro-encapsulated material has a capsule size in the range of from 5 to 40 microns.

4. A method according to claim 1, wherein said leather is conveyed past said roller by a conveyor belt means.

5. A method according to claim 4, wherein said conveyor belt means and said roller have substantially the same linear speed and direction.

6. A method according to claim 5, wherein said conveyor belt means and said roller have a linear speed of between 2 and 10 m/min.

7. A method according to claim 1, wherein the micro-encapsulated material is made into a liquid slurry.

8. A method according to claim 7, wherein said micro-encapsulated material is applied at a rate of between 60 g/m$^2$ and 180 g/m$^2$ of the slurry as a whole.

9. A method according to claim 7, wherein said liquid slurry comprises an aqueous base and one or more thickeners, wetting agents, dispersant and flow aids.

10. A method according to claim 7, wherein said liquid slurry has a viscosity in the range of from 10 to 70 seconds (Ford Cup No. BS9300A6).

11. A method according to claim 1, wherein the thickness of the minimum roller qap is between 60% and 90% of the thickness of the uncompressed leather.

12. A method according to claim 11, wherein the minimum roller gap is approximately 75% of the thickness of the uncompressed leather.

13. A method according to claim 1, wherein said leather is passed past the roller more than once.

14. A method according to claim 1, wherein said material comprises one or more of the following:

biocides, scents, colourants, softening agents, fillers, levelling agents, fault observing agents, abrasion enhancers, magnetic substances, humectants, waterproofing agents and fire-retarding agents.

15. A leather produced in accordance with claim 1.

16. A glove made wholly or partially of a leather according to claim 15.

17. An article of footwear made wholly or partially of a leather according to claim 15.

18. An article of clothing made wholly or partially of a leather according to claim 15.

19. An article of furniture upholstered wholly or partially of a leather according to claim 15.

20. Leather goods made wholly or partially of a leather according to claim 15.

* * * * *